US008287075B2

(12) United States Patent
Kanazawa

(10) Patent No.: US 8,287,075 B2
(45) Date of Patent: Oct. 16, 2012

(54) PRINTING APPARATUS AND SHEET PROCESSING APPARATUS

(75) Inventor: Manabu Kanazawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 248 days.

(21) Appl. No.: 12/825,027

(22) Filed: Jun. 28, 2010

(65) Prior Publication Data

US 2010/0328392 A1 Dec. 30, 2010

(30) Foreign Application Priority Data

Jun. 30, 2009 (JP) ..... 2009-155675

(51) Int. Cl.
*B41J 29/38* (2006.01)

(52) U.S. Cl. ..... 347/16; 347/104

(58) Field of Classification Search ..... 347/5, 16, 347/101, 102, 104–107
See application file for complete search history.

(56) References Cited

U.S. PATENT DOCUMENTS 6,517,200 B1 * 2/2003 Ramaswamy et al. ..... 347/104
6,832,831 B2 * 12/2004 Shima et al. ..... 347/102

FOREIGN PATENT DOCUMENTS

CN 1438123 A 8/2003

* cited by examiner

*Primary Examiner* — Juanita D Jackson
(74) *Attorney, Agent, or Firm* — Canon U.S.A., Inc. IP Division

(57) ABSTRACT

An apparatus includes a printing unit configured to print a plurality of images sequentially onto a continuous sheet while conveying the sheet, a cutter configured to cut the printed sheet into every print unit length, a drying unit configured to dry the cut sheet cut while conveying the sheet piece by piece, and at least one feeding roller situated between the cutter and the drying unit configured to apply a driving force via a torque limiter, wherein a conveyance speed of the cut sheet is larger than the conveyance speed of the sheet conveyed through the drying unit, and the feeding roller absorbs a difference of the conveyance speed according to a function of the torque limiter.

17 Claims, 14 Drawing Sheets

PRINTING APPARATUS AND SHEET PROCESSING APPARATUS

BACKGROUND OF THE INVENTION

1. Field of the Invention

The present invention relates to a technical field of an apparatus that performs processing such as image printing onto a continuous sheet.

2. Description of the Related Art

U.S. Pat. No. 6,832,831 discusses an ink jet printing apparatus that uses a roll sheet and includes a cutter for cutting the sheet after printed and a heating and fixing unit for accelerating a drying time. A speed at which the printed sheet is discharged from a printing unit is larger than a sheet conveyance speed through the heating and fixing unit. Therefore, a loop forming unit in which the sheet is temporarily stored in a form of an unstrained loop between the printing unit and the heating and fixing unit is provided in order to absorb a conveyance speed difference therebetween.

However, the ink jet printing apparatus with the loop forming unit as discussed in U.S. Pat. No. 6,832,831 uses a large space for the purpose of securing a path for forming the loop, and therefore, there is a limit in pursuing downsizing of the apparatus. In the apparatus discussed in U.S. Pat. No. 6,832,831, it is provided that the roll sheet has a sufficient flexibility to the extent that the roll sheet can bend and hang down like a loop under its own weight. More specifically, the apparatus discussed in U.S. Pat. No. 6,832,831 is not suitable for a type of sheet that is relatively rigid and hard to be bent (e.g., a photographic sheet made of thick paper).

SUMMARY OF THE INVENTION

According to an aspect of the present invention, an apparatus includes a printing unit configured to print a plurality of images sequentially onto a sheet while conveying the sheet, a cutter configured to cut the printed sheet into every print unit length, a drying unit configured to dry the cut sheet while conveying the sheet piece by piece, and at least one feeding roller situated between the cutter and the drying unit configured to apply a driving force via a torque limiter, wherein a conveyance speed of the cut sheet is larger than a conveyance speed of the sheet conveyed through the drying unit, and the feeding roller absorbs a difference of the conveyance speed according to a function of the torque limiter.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Composition elements as illustrated in the exemplary embodiments are mere examples, and thus a scope of the present invention is not limited by those exemplified composition elements. A high speed line type printing apparatus of an ink jet method, in which a line type print head is used, is exemplified below. For example, the high speed line type printing apparatus is suitable for a field, e.g., a printing laboratory, in which a vast number of sheets are printed. The present invention is widely applicable to printing apparatus such as a printer, a printer multifunction peripheral, a copying machine, a facsimile machine and various devices.

Figure 1:
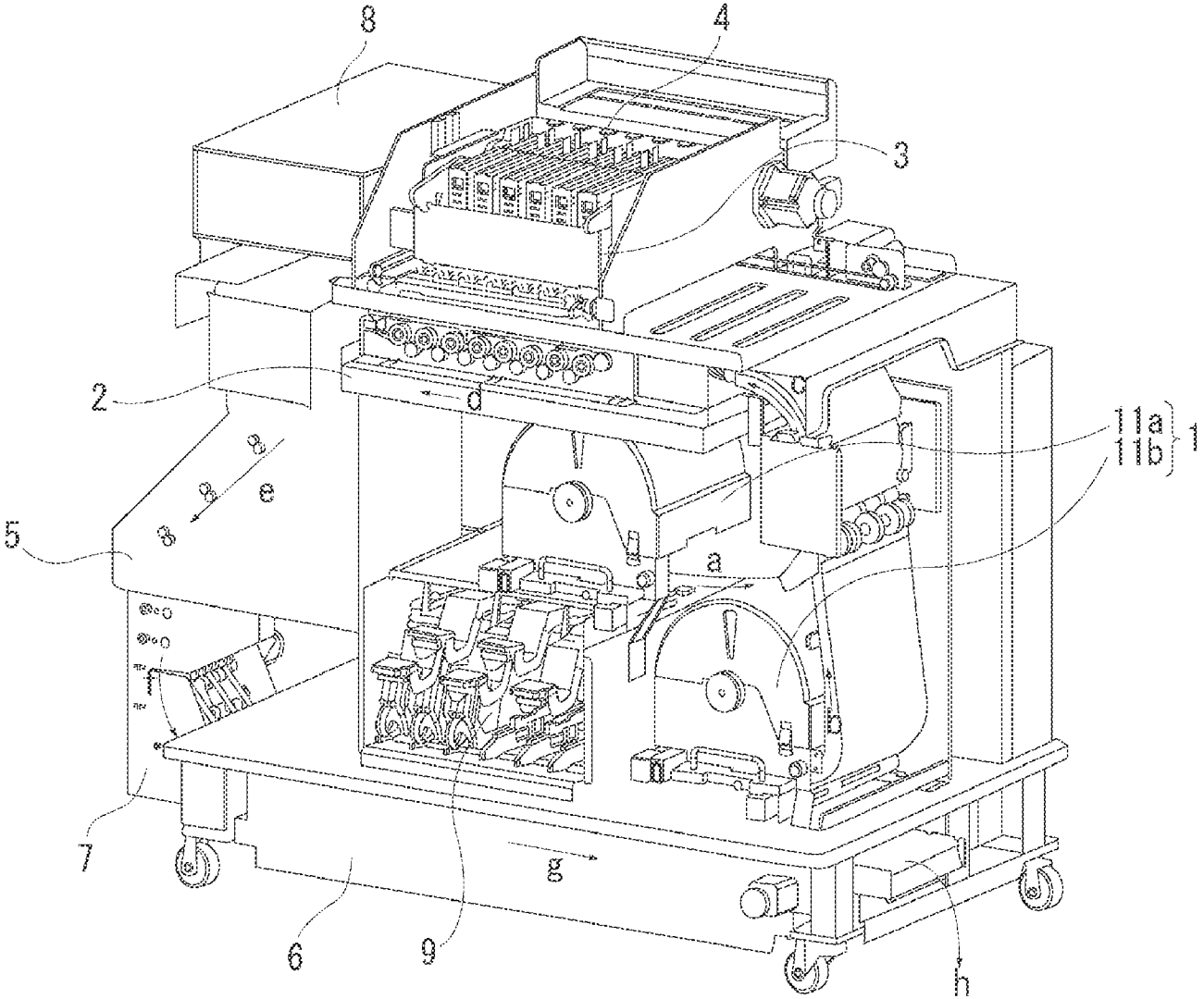
FIG. 1 illustrates a configuration of a printing apparatus in its entirety according to a first exemplary embodiment.

FIG. 1 illustrates a configuration of a whole printing apparatus that sequentially prints a plurality of images by using a roll sheet (a long continuous sheet that is longer than a print unit in a conveyance direction) according to a first exemplary embodiment of the present invention. The apparatus includes a roll sheet unit 1, a conveyance unit 2, a printing unit 3, a print head 4, a cutter unit 5, a drying unit 6, a speed absorbing unit 7, a control unit 8 and ink tanks 9, which are disposed within a housing of the apparatus. The control unit 8 includes a control section including a controller and various input and out put (I/O) interfaces in order to control various operations of the whole apparatus. A sheet is conveyed by a conveyance mechanism formed by roller pairs and a belt provided along a sheet conveyance path, i.e., from an arrow "a" direction to an arrow "h" direction in FIG. 1. While the sheet is conveyed, the sheet is subjected to the respective processing at each of the units. At an arbitrary position of the sheet conveyance path, a side nearer to the roll sheet unit 1 is referred to as an "upstream" and the opposite side thereof is referred to as a "downstream".

The roll sheet unit 1 includes two cassettes, i.e., an upper sheet cassette 11*a* and a lower sheet cassette 11*b*. A user loads a roll sheet, which is rolled into a roll shape, in a holder and inserts the holder from a front side into the main body of the printing apparatus to load the roll sheet. The sheet to be loaded into the main body of the printing apparatus is not limited to the roll sheet but may be any sheet as far as the sheet is continuous. For example, the sheet may be a continuous sheet which is provided with perforations for every unit length and folded at each perforation to be laminated. The sheet drawn out from the upper sheet cassette 11*a* is conveyed in the arrow "a" direction in FIG. 1 and the sheet drawn out from the lower sheet cassette 11*b* is conveyed to the arrow "b" direction in FIG. 1. The sheets conveyed from both of the cassettes are further conveyed to the arrow "c" direction in FIG. 1, resulting in reaching the conveyance unit 2.

The conveyance unit 2 conveys the sheet, while it is printed, in the arrow "d" direction (in a horizontal direction) in FIG. 1 by using a plurality of rotation rollers. A printing unit 3 is disposed above the conveyance unit 2 so as to face the conveyance unit 2. In the printing unit 3, independent print heads 4 for a plurality of colors (6 colors here) are held along the sheet conveyance direction. In synchronization with the conveyance of the sheet by the conveyance unit 2, inks are ejected from the print heads 4 to form an image on the sheet. A print mechanism is formed by the conveyance unit 2, the printing unit 3 and the print heads 4 which are described above. Ink tanks 9 store various colors of inks, independently. Each of the inks is supplied from the ink tank through a tube to a sub tank which is provided for a corresponding color of ink. Subsequently, the ink is supplied from the sub tank through a tube to the corresponding print head 4. The control unit 8 includes a controller and various I/O interfaces in order to control various operations of the whole apparatus.

The sheet discharged from the conveyance unit 2 is conveyed in the arrow "e" direction to be led into the cutter unit 5. In the cutter unit 5, a cutter built in the cutter unit 5 cuts a continuous sheet into a predetermined print unit length. The predetermined print unit length differs according to an image size to be printed. For example, a length in the conveyance direction is set to 135 mm in a case of an L-size photograph, and a length in the conveyance direction is set to 297 mm in a case of A4-size photograph. What is formed in an area of a single print unit is not limited to one image, and the area may includes a plurality of small images, characters, blanks or a mixture thereof, or may be a mere blank page.

A drying unit 6 heats the sheet passing through the drying unit 6 in the arrow "g" direction in FIG. 1 by applying hot air in order to dry the sheet on which inks are applied within a short time period. The sheets cut into the unit length pass through the drying unit 6 sheet by sheet and are discharged in the arrow "h" direction in FIG. 1. Thereafter, the discharged sheets are stacked on the discharge tray. Between the cutter unit 5 and the drying unit 6 on the conveyance path, the speed absorbing unit 7 is provided in order to absorb a conveyance speed difference between the cutter unit 5 and the drying unit 6. Details thereof are described below. In the speed absorbing unit 7, the sheet is conveyed in the arrow "f" direction in FIG. 1.

Figure 2:
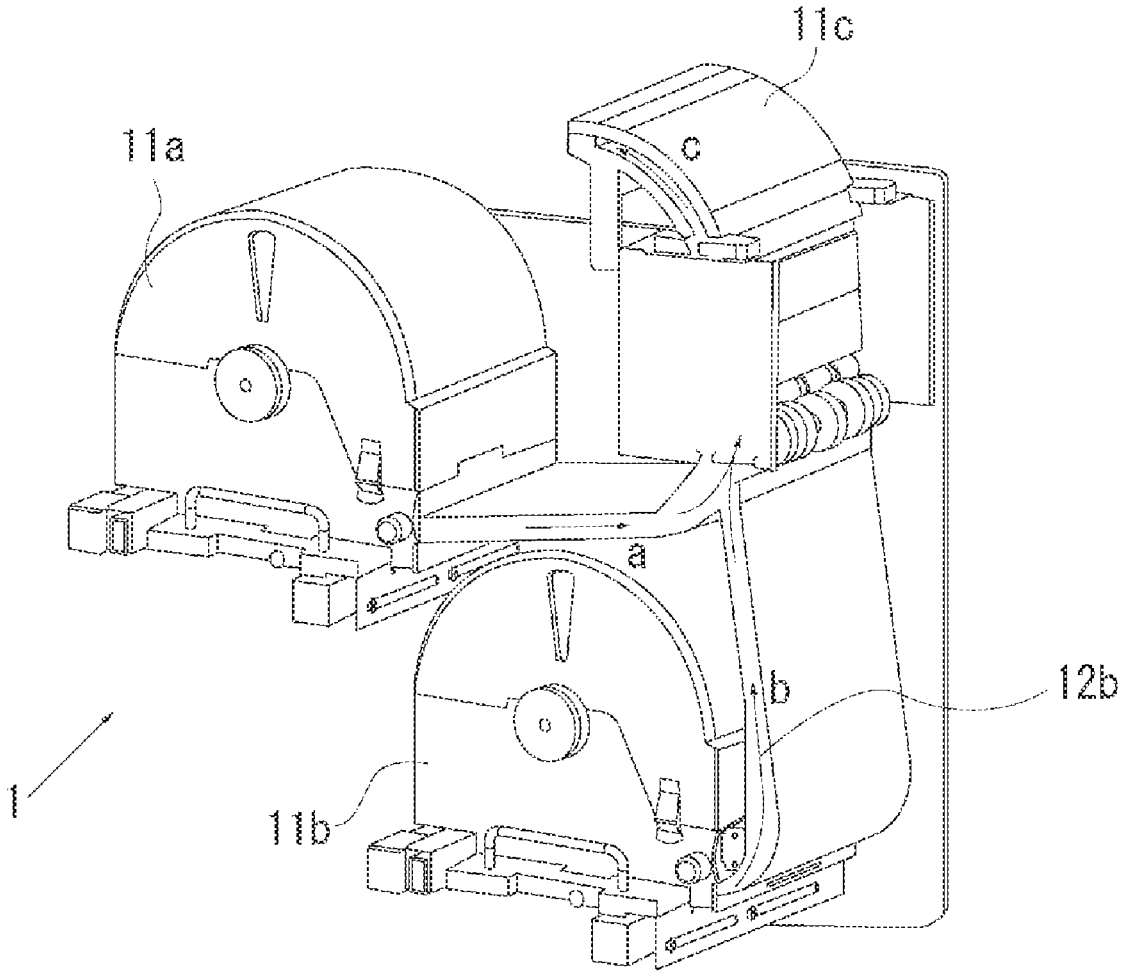
FIG. 2 illustrates a configuration of a roll sheet unit.

FIG. 2 illustrates a configuration of the roll sheet unit 1. The upper sheet cassette 11*a* and the lower sheet cassette 11*b* include roll sheets, respectively. The roll sheet drawn out from one of the sheet cassettes is supplied to the conveyance unit 2 at a conveyance speed of a speed "A" (e.g., 75 mm/sec.). The speed is equivalent to the speed A at which the sheet is conveyed through the conveyance unit 2 while the sheet is subjected to print processing.

Figure 3:
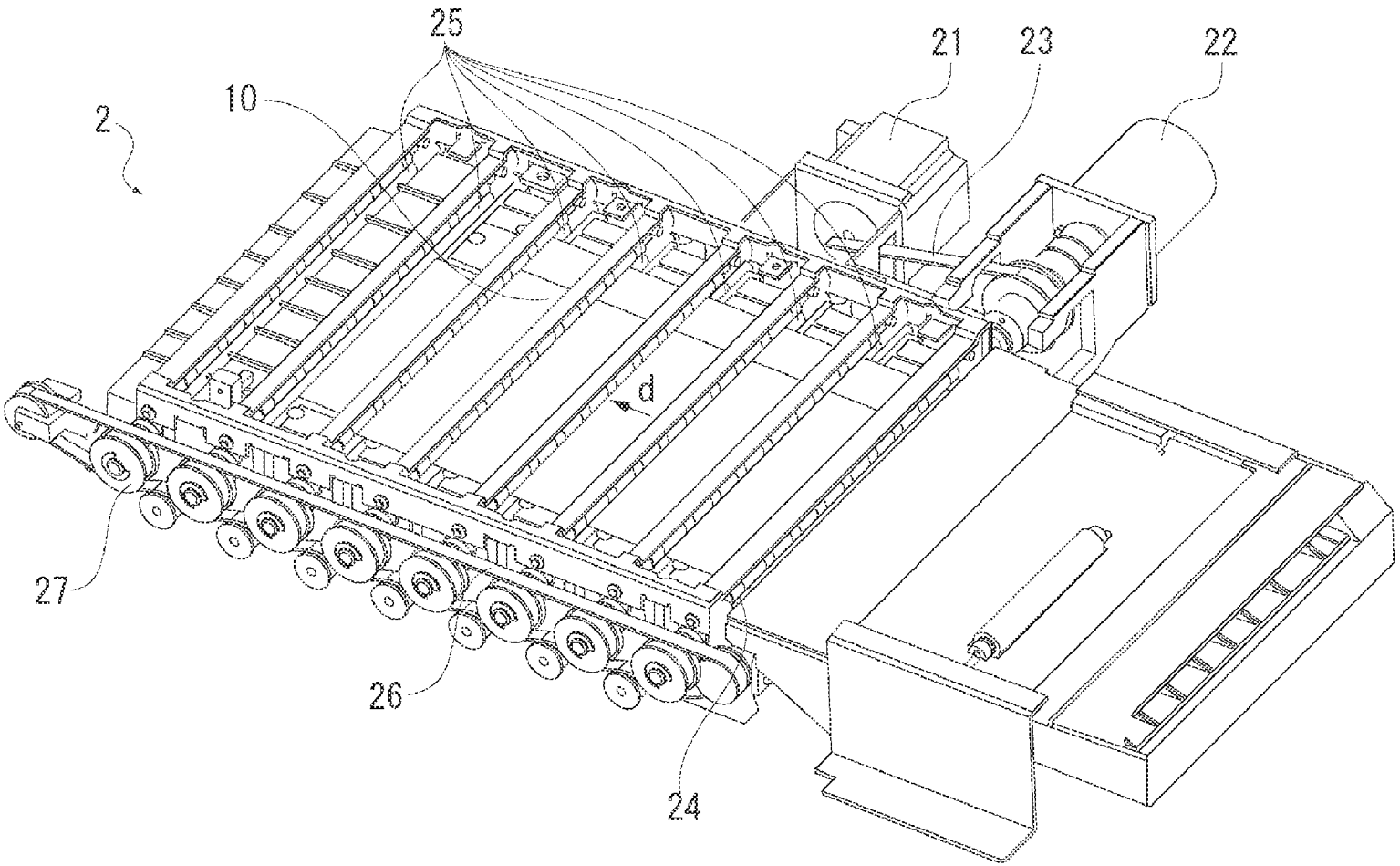
FIG. 3 illustrates a configuration of a conveyance unit.

FIG. 3 illustrates a configuration of the conveyance unit 2. A rotary driving force of a conveyance motor 21 is transmitted by a belt 23 to cause a conveyance roller 24 to rotate. A rotating state (rotating angle) of the conveyance roller 24 is detected by a rotary encoder 22. Based on an output detected by the rotary encoder 22, the conveyance motor 21 is controlled under a feedback control as well as an ink ejection timing upon printing is controlled. The rotary driving force of the conveyance roller 24 is transmitted to a plurality of feeding rollers 25 (e.g., 7 feeding rollers in the present exemplary embodiment) by a transmitting mechanism including a belt 26 and pulleys 27. The plurality of feeding rollers 25 and the conveyance roller 24 rotate at the same circumferential velocity, thereby conveying a sheet 10. The conveyance speed of the sheet 10 during the print processing is constant at the speed A.

Figure 4:
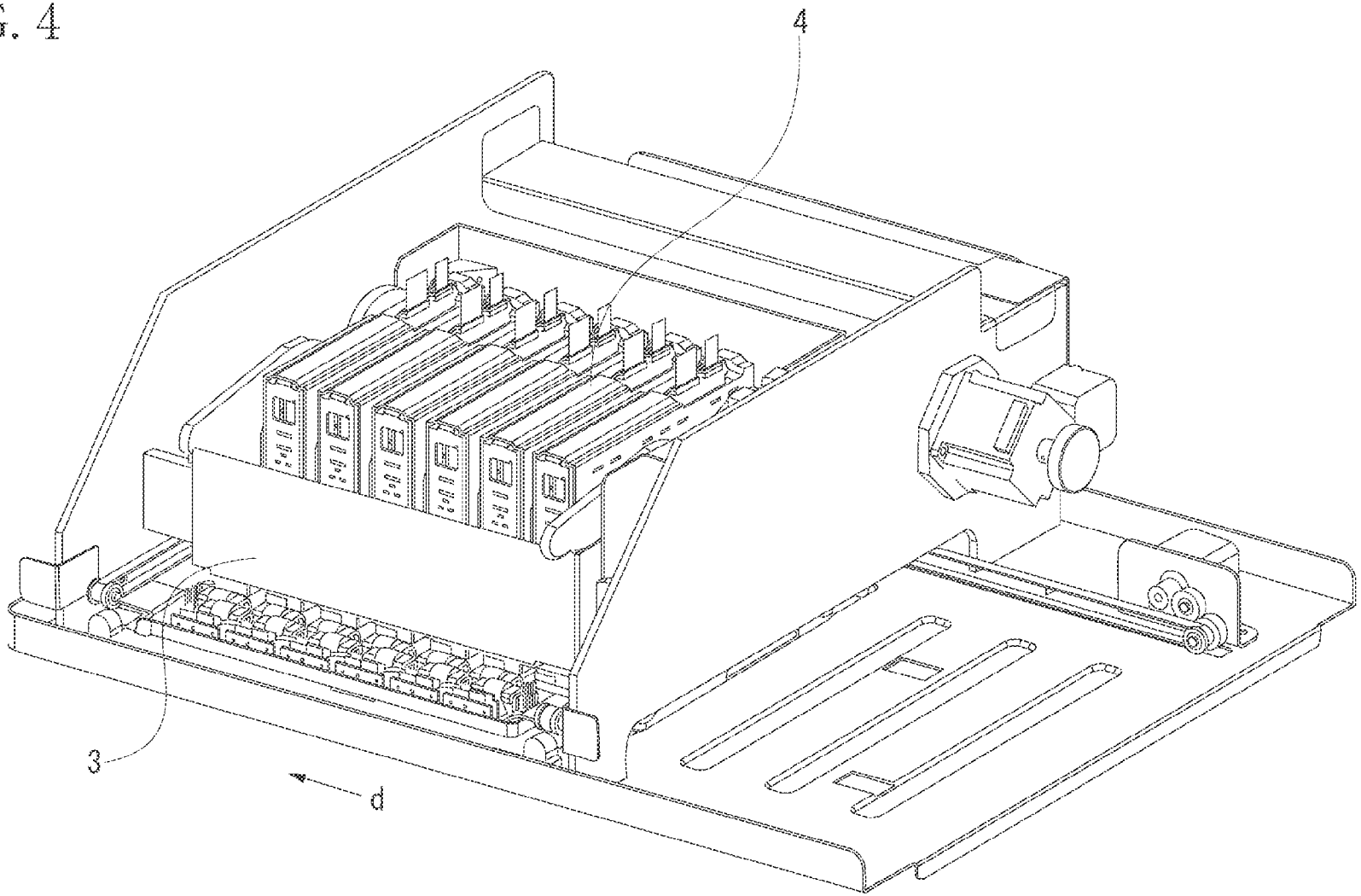
FIG. 4 illustrates a configuration of a head unit.

FIG. 4 is a configuration of the printing unit 3. Line heads of the print heads 4 are aligned color by color (6 colors) along the conveyance direction "d" upon print processing. The line heads of the respective colors may be formed of seamless one-piece nozzle chips or may include a plurality of divided nozzle chips which are aligned systematically, e.g., in a line alignment or in a zigzag alignment. In the present exemplary embodiment, a plurality of nozzles is aligned within a range which covers a maximum width of a sheet to be used, which is referred to as a full-multiple head. An ink jet method for ejecting an ink through a nozzle can employ a method of using a heating element, a method of using a piezoelectric element, a method of using an electrostatic element, a method of using a micro-electro-mechanical (MEMS) system element or the like. The ink is ejected from each of the nozzles in the heads based on print data. A timing for ejection the ink is determined by an output signal from the rotary encoder 22. The present invention is not limited to the inkjet type printing apparatus, but may be applicable to various print systems such as a thermal printer (a sublimation printer, a thermal transfer printer or the like), a dot impact printer, a light emitting diode (LED) printer or a laser printer.

Figure 5:
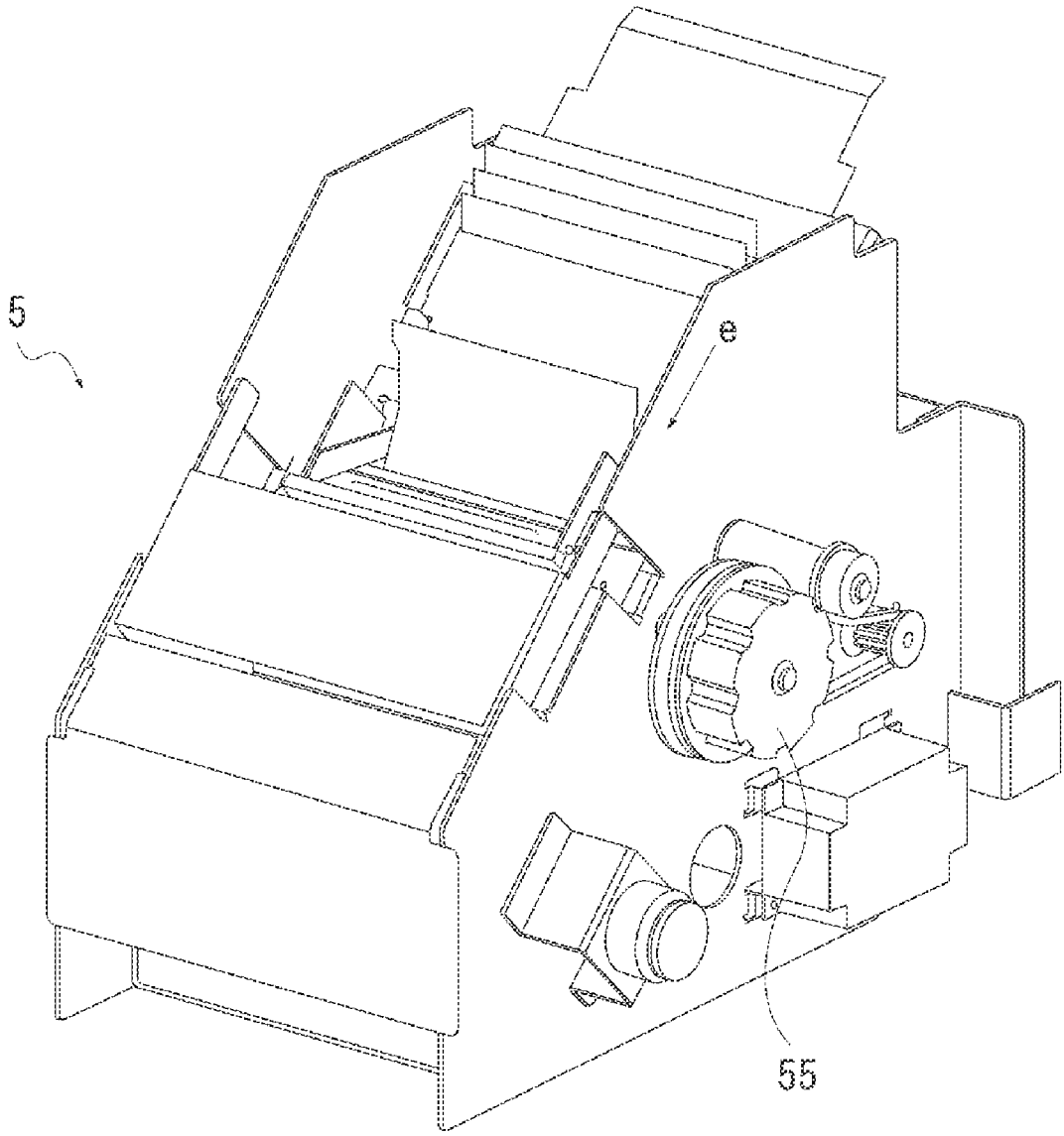
FIG. 5 illustrates a configuration of a cutter unit.

FIG. 5 illustrates a configuration of the cutter unit 5. In the cutter unit 5, the sheet 10 is conveyed in an arrow "e" direction in FIG. 5. The conveyance speed of the sheet 10 when the sheet 10 enters into the cutter unit 5 is the speed A which is equivalent to the conveyance speed of the sheet in the conveyance unit 2. A motor 55 is a driving source for conveying the sheet through the cutter unit 5.

Figure 6A:
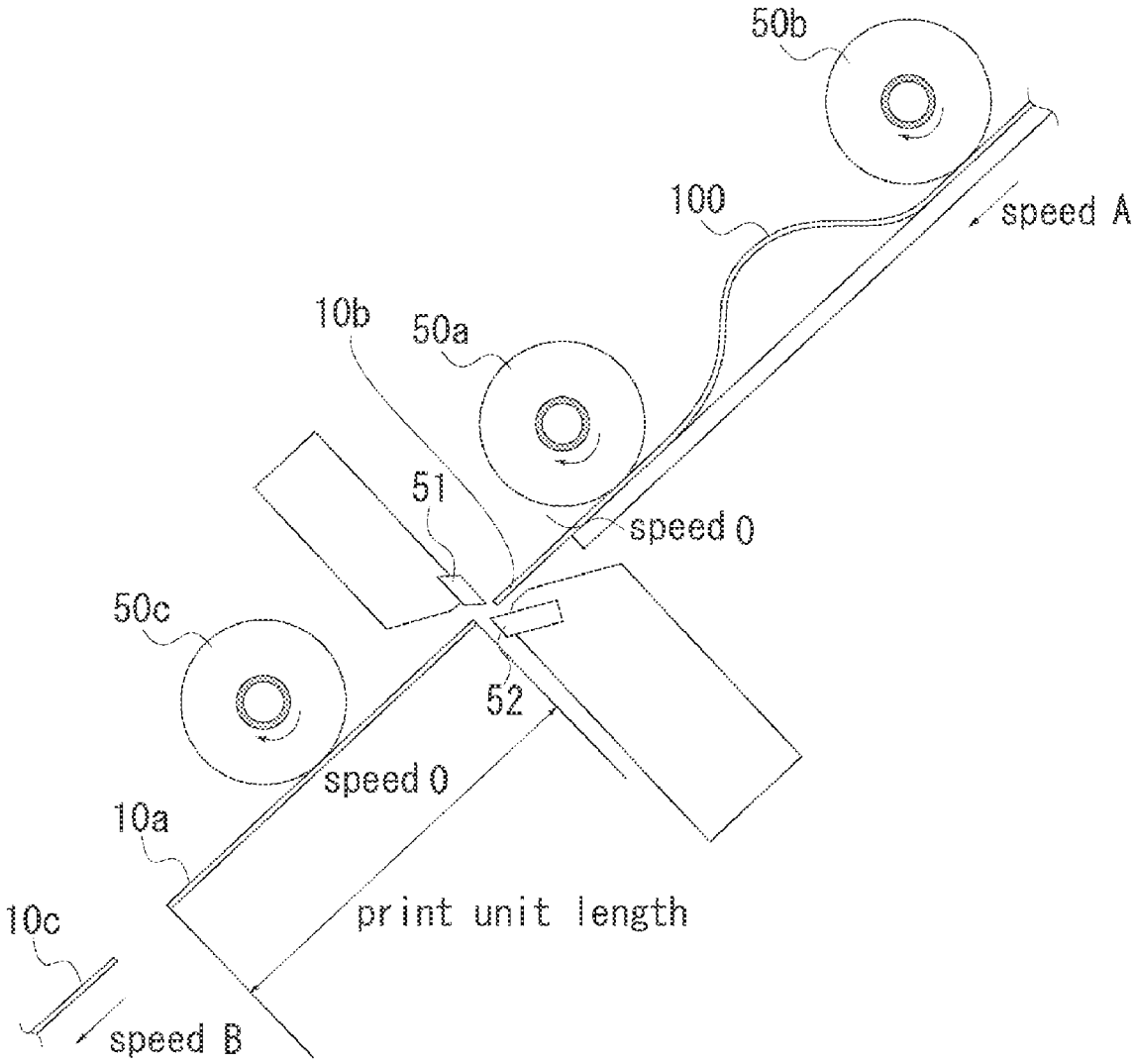
FIGS. 6A and 6B are cross sectional views of the cutter unit (an example of a first cut).
Figure 6B:
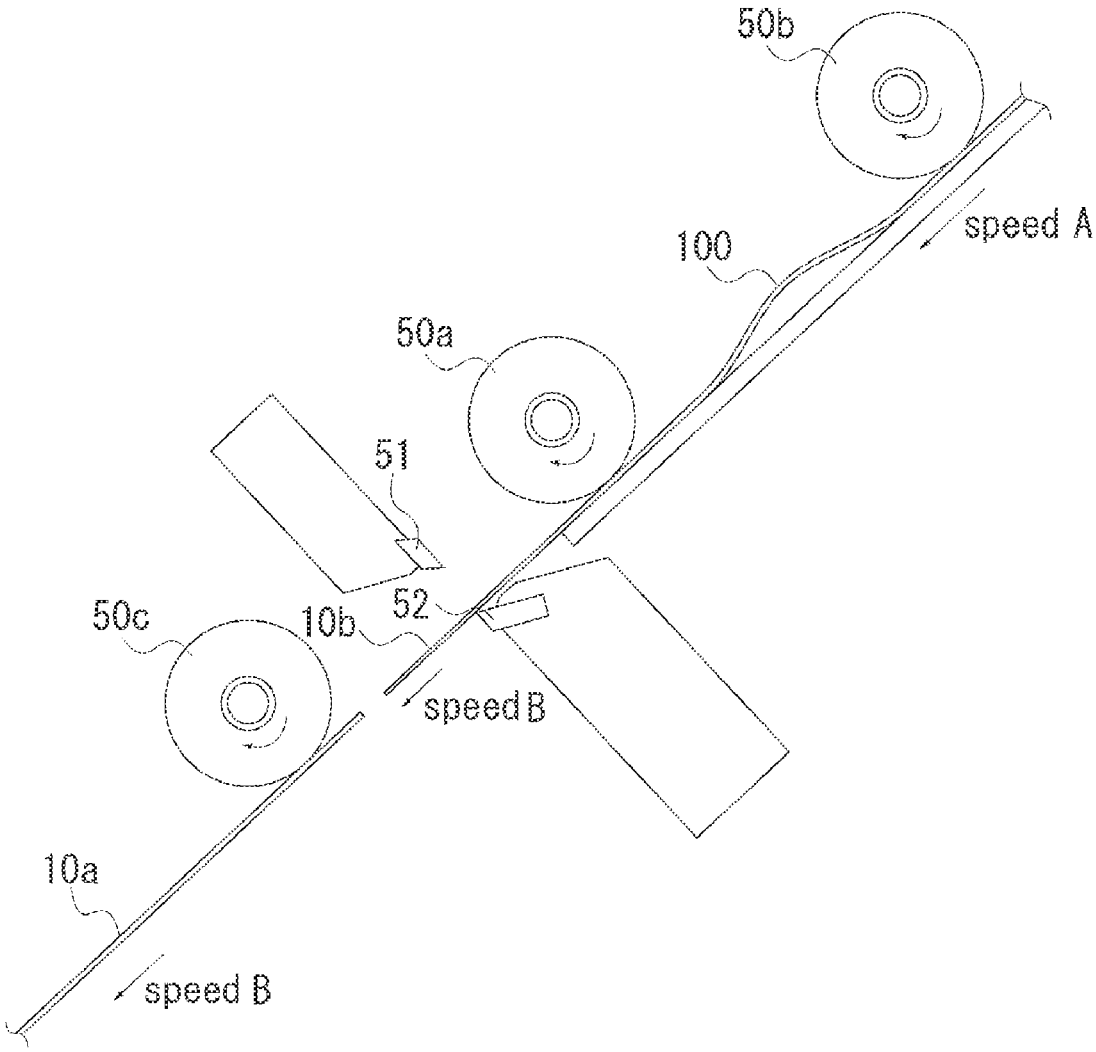

FIGS. 6A and 6B are partial cross sectional views illustrating a sheet cutting operation. A cutter includes a movable blade 51 and a stationary blade 52 in order to cut the sheet. The cutter unit 5 includes conveyance rollers 50*a*, 50*b* and 50*c* for conveying the sheet. FIG. 6A illustrates a state when the cutter unit 5 is cutting the sheet. Rotations of the conveyance roller 50*a* (upstream side) and the conveyance roller 50*c* (downstream side) which are closest to a cutting position of the cutter are temporarily stopped while the sheet is cut. Therefore, in the upstream side and the downstream side of the cutting position, the conveyance speed of the conveyed sheets locally becomes 0. Since a sheet 10*a* which has been cut into a print unit length and is in the downstream side of the cutting position is also temporarily stopped to be conveyed, the sheet would not be pulled from the downstream side while the sheet is under cutting. A sheet 10*c* which has already been cut and is in further downstream side of the sheet 10*a* is discharged smoothly at a speed "B" without being affected by the cutting operation. Consequently, while the sheet is cut, a distance between the sheet 10*c* and the sheet 10*a* becomes larger. However, the spaced distance is gradually narrowed while the sheets pass through the speed absorbing unit 7 and reach the drying unit 6 in a manner described below. While the sheet is cut, the conveyance roller 50*b* which is disposed in the upstream side of the conveyance roller 50*a* continuously rotates at a circumferential velocity A to convey the sheet. In the path between the conveyance roller 50*a* and the conveyance roller 50*b*, a length of the sheet temporarily becomes longer than a length of the path to thus form a locally curved portion (a loop portion 100) of the sheet 10*b*.

FIG. 6B illustrates a state that the sheet 10 is conveyed again after being cut. At the time of completion of the cutting, both of the conveyance rollers 50*a* and 50*c* which have been stopped resume rotating at a circumferential velocity B (>speed A). The cut sheet 10*a* in the downstream side is discharged from the cutter unit 5 at the conveyance speed B according to a rotation of the conveyance roller 50*c*. The conveyance roller 50*b* continues to rotate still at the circumferential velocity A. The conveyance roller 50*a* conveys the sheet 10*b* at the conveyance speed B and the conveyance roller 50*b* conveys the sheet at the conveyance speed A, so that the loop portion 100 of the sheet 10*b* is gradually eliminated according to a speed difference (B−A). At a timing at which the loop 100 is completely eliminated, the conveyance roller 50*a* returns to the conveyance speed A. In this manner, the sheet 10*a* and the sheet 10*b* are discharged at the same speed B. Then, after the sheet 10*b* is conveyed by the print unit length, the sheet 10*b* is stopped to be conveyed again and cut in a manner as illustrated in FIG. 6A. The processing is repeated hereinafter.

The above description is based on an assumption that there is no margin between one image and the following image while the images are printed side by side. On the other hand, there is a case where a margin area is provided between the one image and the following image when a plurality of images is printed sequentially onto a continuous sheet. In the margin area, a cut mark as a reference position for cutting the sheet by the cutter or a test pattern for maintenance of the print heads may be formed. The margin area is finally cut off by the cutter since the margin area is not necessary. In this case, the sheet may be cut twice at a leading edge and a trailing edge of the margin area in order to cut off the margin area.

Figure 7:
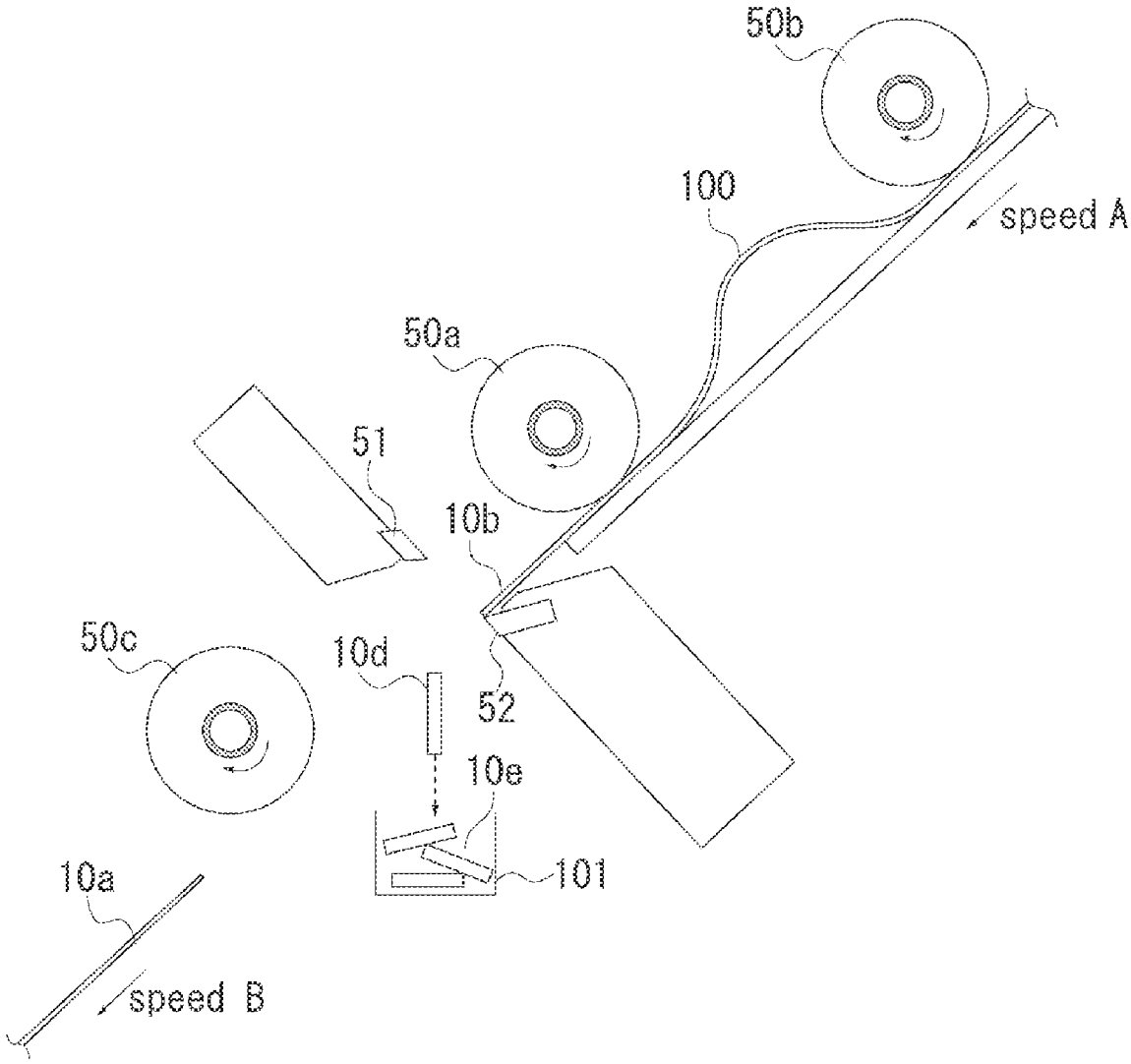
FIG. 7 is a cross sectional view of the cutter unit (an example of a second cut).

A first cut (of the leading edge of the margin area) is illustrated in FIG. 6A. Subsequently, a second cut (of the trailing edge of the margin area) is performed. FIG. 7 illustrates a state when the second cut is performed. Only the conveyance roller 50*a* is stopped while the trailing edge of the margin area is cut. The cut off margin area becomes a sheet slip 10*d* and falls down. A trash box 101 is provided at a position where the sheet slip 10*d* falls down. In the trash box 101, the cut off sheet slips 10*e*, which are cut off every time an image is printed, are collected.

In FIG. 7, there is a relatively large space between the trailing edge of the antecedent sheet 10*a* and the leading edge of the following sheet 10*b*. This is because the sheet 10*a* is continuously discharged at the speed B while the sheet 10*b* is stopped for the second cut. While the antecedent sheet 10*a* is affected only once by the cutting of the leading edge of the margin area, the following sheet 10*b* is affected by the cutting of the trailing edge of the margin area in addition to the leading edge thereof. A distance finally made between the sheet 10*a* and the sheet 10*b*, which are resultantly cut and discharged, becomes a sum of distances the sheet 10*a* moves forward in a stopped period at the first cut and a stopped period at the second cut.

As a condition for drying the sheet after printing, if the drying ability of the drying unit 6 per a unit time (a temperature and moisture of an ambient within the unit) is constant, a predetermined drying time is minimum consumed. In other words, a drying time more than a value obtained by dividing a length of path within the unit of the drying unit 6 by a conveyance speed within the unit (a constant value) is used. For the sake of downsizing of the whole apparatus, the length of the path within the unit is desired to be as short as possible. For the purpose thereof, the conveyance speed is to be set to as small as possible. On the other hand, if the conveyance speed is set to too small value, a speed dramatically drops down in the drying unit which causes an impact on or overlapping with the following cut sheet. A distance between the antecedent sheet and the following sheet is determined by cutting time in the cutter unit 5 (conveyance stop time), the conveyance speed A and the conveyance speed B. If a sufficient distance between the sheets is secured, printing throughput of the whole printing apparatus would be reduced. In view of a balance of the above described conditions, the conveyance speed in the drying unit 6 is set to the speed A (that is identical to the conveyance speed in the printing unit). The conveyance speed in printing is not necessarily set to the value identical to the speed in the drying unit. If the speed in the drying unit is larger than the conveyance speed in printing, no impact will occur between the antecedent sheet and the following sheet. However, as described above, since the speed cannot be set to such a large value for the sake of achieving downsizing of the drying unit 6, a speed ratio between the antecedent sheet and the following sheet is within a range between 1.0 and 1.1 times. The conveyance speed B is set to a value by which the loop portion 100 of the sheet 10 can be almost eliminated before the cut sheet 10 reaches the drying unit 6 from the cutter unit 5 (e.g., 1.5*speed A=112.5 mm/sec). Details of the speed to be set are described below.

Figure 8:
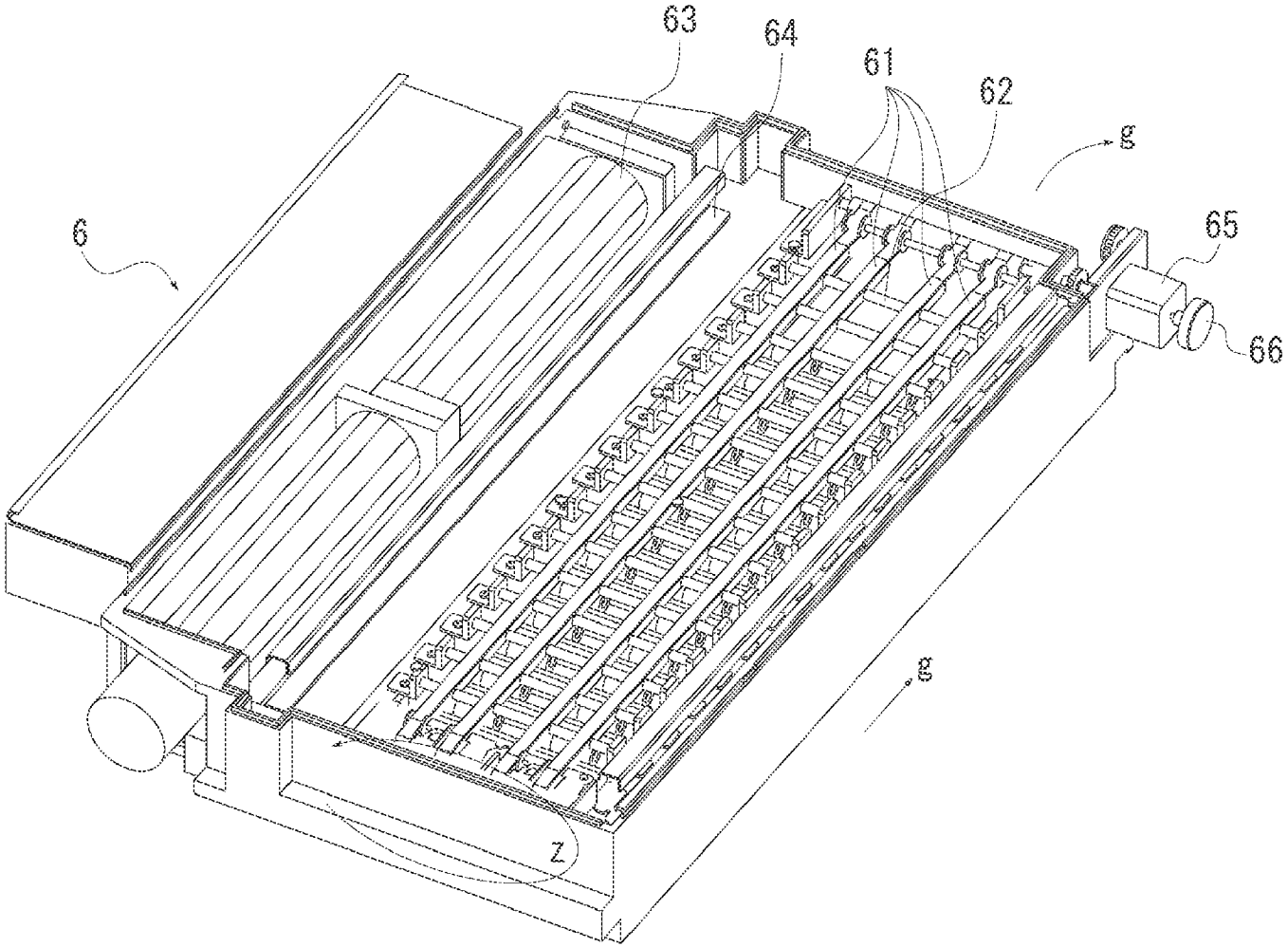
FIG. 8 illustrates a configuration of a drying unit.

FIG. 8 illustrates a configuration of an inside of the drying unit 6. The sheet is moved while being sandwiched between a plurality of conveyance belts 61 and rollers 62. The plurality of conveyance belts 61 receives a rotary driving force of a motor 65. A rotating state of the motor 65 is detected by a rotary encoder 66 and the motor 65 is controlled under the feedback control. A printed surface to which inks are applied and dried is placed with a face down. Air heated by a heater 64 is circulated by a fan 63 in a "Z" direction in FIG. 8 to accelerate drying of the sheet which is conveyed in an arrow "g" direction at the speed A in FIG. 8. The sheet tends to be curled because of fast drying; however, since the sheet is sandwiched between the conveyance belts 61 and the rollers 62 during drying, curling is suppressed.

Figure 9:
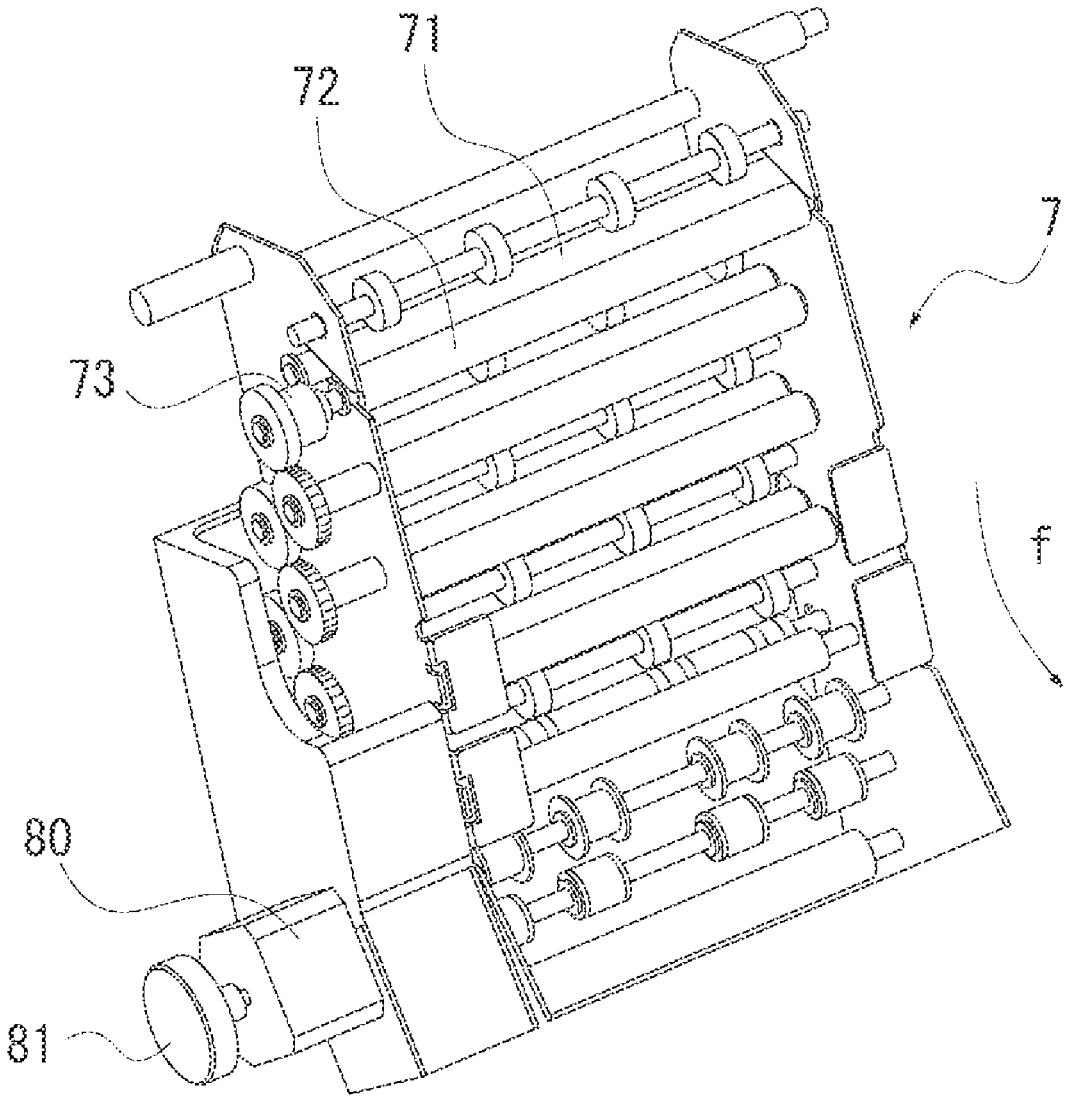
FIG. 9 illustrates a configuration of a speed absorbing unit according to the first exemplary embodiment.

FIG. 9 illustrates a configuration of the speed absorbing unit 7. The speed absorbing unit 7 includes a plurality of pairs of a feeding roller 71 and a driven roller 72 which are aligned along the conveyance path. A rotary driving force of a motor 80 is transmitted to each of the plurality of feeding rollers 71 via a gear train. A rotating state of the motor 80 is detected by a rotary encoder 81 and the motor 80 is controlled under the feedback control. A torque limiter 73 (a slipping clutch) is mounted on a shaft of each of the feeding rollers 71 and the rotary driving force is transmitted to each feeding roller 71 via the corresponding torque limiter 73. Regarding an idling torque of the torque limiter 73, a torque value is set such that the torque limiter runs idle before the sheet is buckled in a case where the leading edge side of the sheet is jammed although the torque limiter does not run idle according to a load applied by the normal sheet feeding. In other words, the idling torque of the torque limiter is smaller than a load that the sheet is buckled in a case where the downstream side of the sheet is jammed and is larger than a load that the sheet is conveyed. As described above, the speed absorbing unit 7 includes the plurality of feeding rollers 71 aligned along the conveyance direction. The torque limiter 73 is mounted to each of the feeding rollers 71. Further, a length of the conveyance path within the speed absorbing unit 7 is longer than a print unit length of a single piece of the sheet in the conveyance direction. In the present exemplary embodiment, there is the plurality of feeding rollers 71 with torque limiters mounted thereon, however, the number of feeding rollers may be at least one.

Figure 10A:
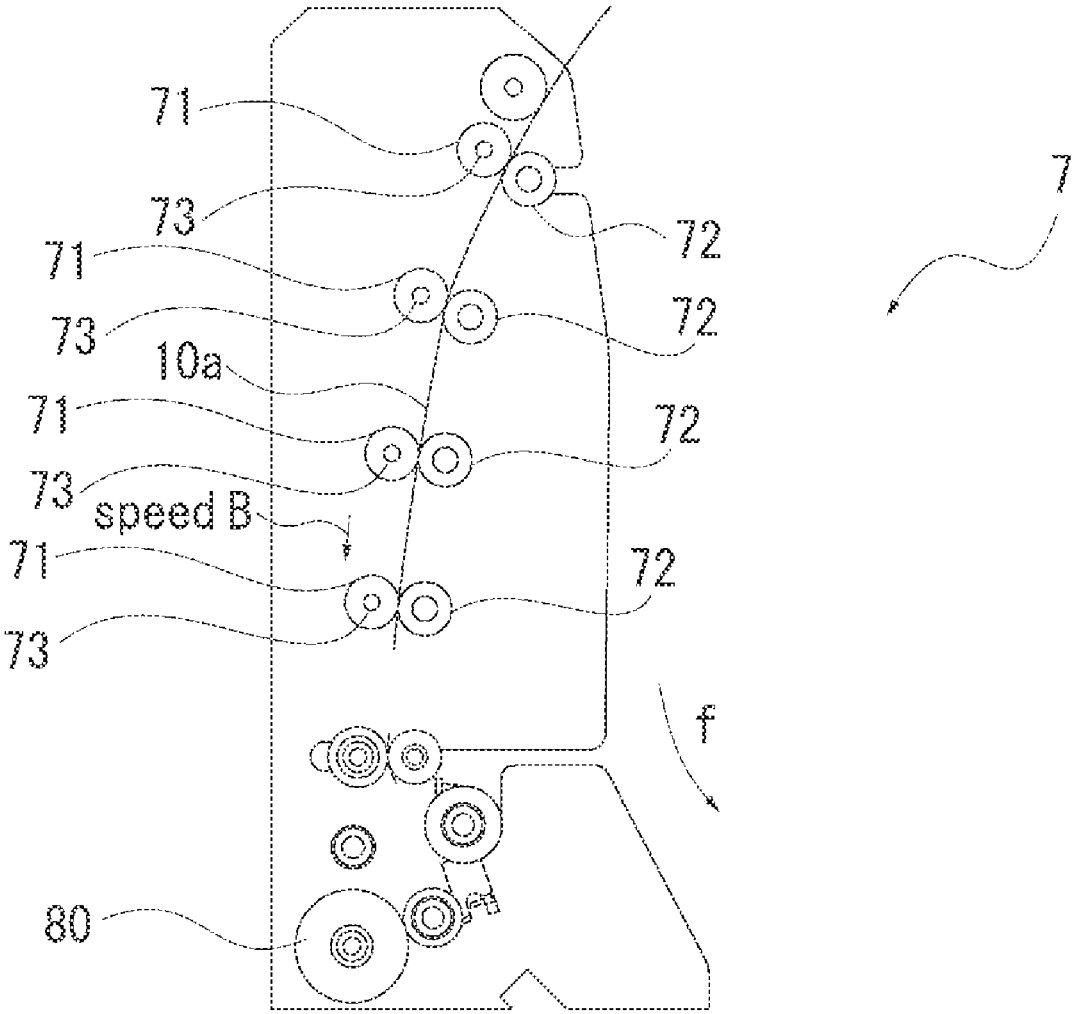
FIGS. 10A and 10B are cross sectional views of the speed absorbing unit according to the first exemplary embodiment.
Figure 10B:
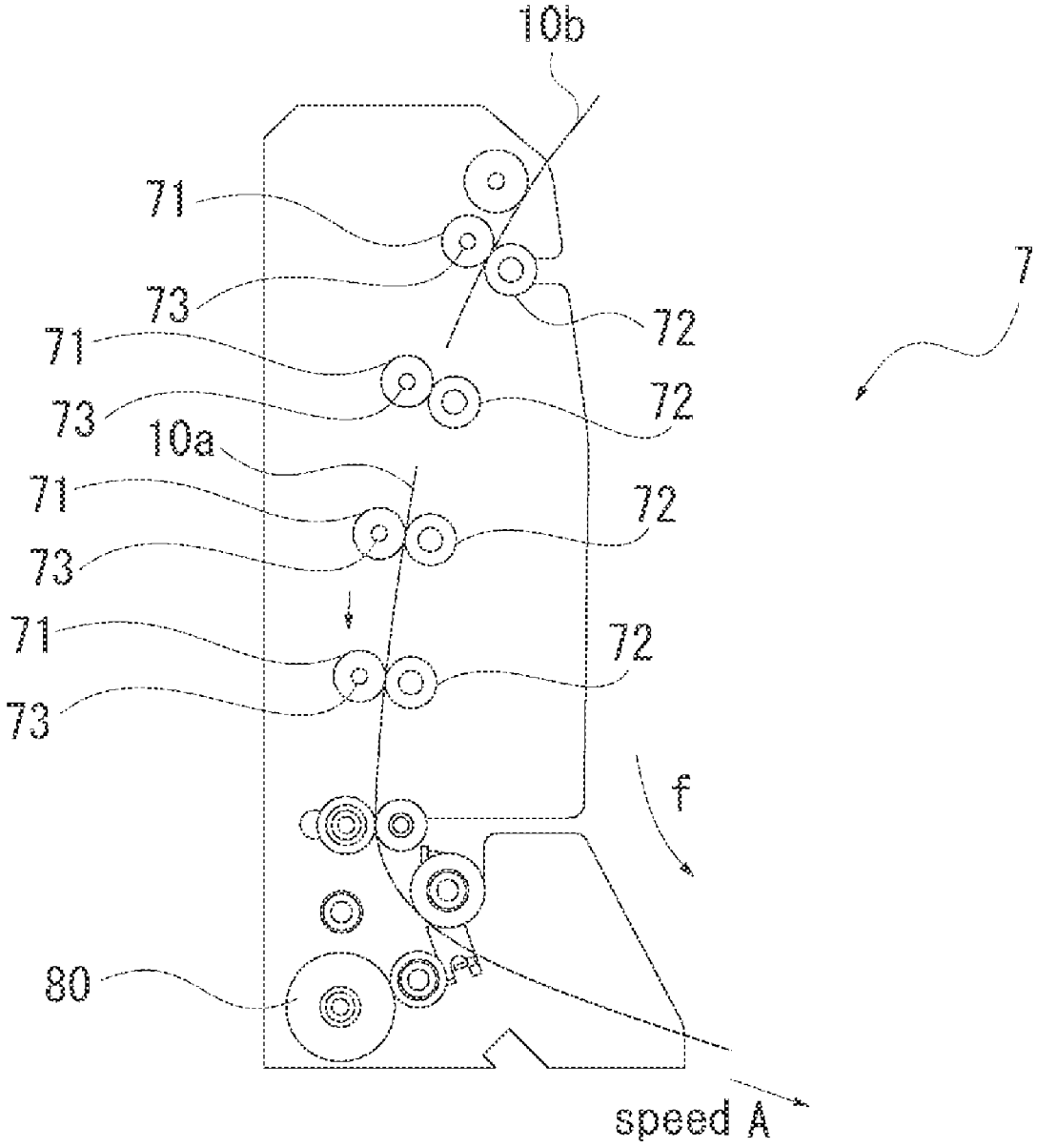

FIGS. 10A and 10B are cross sectional views illustrating an operation of the speed absorbing unit 7. FIG. 10A illustrates that a piece of sheet 10*a* having been cut into a print unit length is led into the speed absorbing unit 7 and the leading edge of the sheet 10*a* is within the speed absorbing unit 7. Within the speed absorbing unit 7, the conveyance speed of the plurality of feeding rollers 71 is set to the speed B and thus there is no speed difference between the conveyance speed of the plurality of feeding rollers 71 and the conveyance speed of the sheet discharged from the cutter unit 5 at the speed B. A length of the conveyance path from the cutting position of the cutter to an entrance of the drying unit 6 (a length of the conveyance path within the speed absorbing unit 7) is larger than a length of the sheet in the conveyance direction which has cut into the maximum print unit length assumed to be used. Therefore, the piece of cut sheet is conveyed at the conveyance speed B through the speed absorbing unit 7. If the maximum size of printing is, for example, the A4 size photograph, the maximum print unit length is set to 297 mm.

FIG. 10B illustrates a state that the leading edge of the sheet 10*a* passes through the speed absorbing unit 7 to move to the drying unit 6. The leading edge of the sheet 10*b* following the antecedent sheet 10*a* is coming into the speed absorbing unit 7. Within the drying unit 6, as described above, the sheet is conveyed at the conveyance speed A which is smaller than the speed B. When the leading edge of the sheet 10*a* is sandwiched between the conveyance belts 61 and the rollers 62 within the drying unit 6, a speed of the sandwiched portion is reduced to the speed A. The speed difference between the speed B and the speed A is also transmitted to the downstream side of the sheet 10 as brake force. Then, the brake force affects on the feeding rollers 71 as a force that decreases the rotational speed of the feeding rollers 71 in which the sheet 10 is sandwiched. Due to this force, the torque limiter 73 is idled. The torque set value of the torque limiter 73 for this operation is as described above. The motor 80 maintains the rotational speed according to the speed B. However, since a clutch of the torque limiter 73 slips, the rollers 71 actually come to be the rotational speed according to the speed A. Accordingly, an overall conveyance speed of the sheet 10*a* is decreased to the speed A. FIG. 10B illustrates that the sheet 10 is conveyed at the conveyance speed A through the drying unit 6. Each of the feeding rollers within the speed absorbing unit 7 returns to the original circumferential velocity B when the trailing edge of the sheet 10 has passed through the speed absorbing unit 7 since the idling of the torque limiter 73 is eliminated.

While the antecedent sheet 10*a* is conveyed through the speed absorbing unit 7 at the speed A, if the following sheet 10*b* enters into the speed absorbing unit 7 at the speed B (larger than the speed A) without a sufficient space between the antecedent sheet 10*a* and the following sheet 10*b*, the impact or overlapping may occur between the antecedent sheet 10*a* and the following sheet 10*b* before the sheet 10*a* reaches the drying unit 6. Conditions for avoiding the above event are described below.

If a parameter is provided that:

a length of the conveyance path between the cutting position of the cutter and the drying unit is L;

a length of the cut sheet in the conveyance direction is M;

a conveyance speed through the drying unit 6 is A;

a sheet discharging speed from the cutter after the sheet is cut is B; and a time period to stop conveying the sheet while the sheet is cut by the cutter (when the sheet is cut twice, the sum of the time period corresponding to these time periods) is T, a distance between the sheets immediately after the sheets are cut is obtained by the following formula (formula 1).

$$B*T \quad \text{(formula 1)}$$

A time consumed for the sheet that is conveyed at the speed B catching up with the sheet that is conveyed at the speed A before the sheet that is conveyed at the speed A reaches the drying unit 6 is obtained by the following formula (formula 2).

$$(B*T)/(B-A) \quad \text{(formula 2)}$$

A time consumed for changing the speed B to the speed A before the sheet that is conveyed at the speed B reaches the drying unit 6 is obtained by the following formula (formula 3).

$$L/B \quad \text{(formula 3)}$$

Before the leading edge of the following sheet 10*b* catches up with the trailing edge of the antecedent sheet 10*a*, if the speed of the sheet 10*b* is switched from the speed B to the speed A, no impact occurs. To satisfy the above, the following formula (formula 4) is obtained by using the above described formulas. A value of each parameter is set so as to satisfy this relational formula.

$$L/B<(B*T)/(B-A) \text{ and}$$

$$M<L \quad \text{(formula 4)}$$

As described above, according to the present exemplary embodiment, the speed difference of the conveyance speed is absorbed according to the function of the torque limiter by disposing the speed absorbing unit 7, between the cutter and the drying unit, which includes the plurality of feeding rollers to which the driving force is applied via each of the corresponding torque limiters. Therefore, such a printing apparatus can be realized that both of downsizing of the apparatus based on the downsizing of the drying unit 6 as well as improvement of the throughput at high level are achieved. Further, since there is no portion where the sheet is forced to be curved, sheets with various types of rigidity can be used in the printing apparatus. Thus, the printing apparatus which can realize both of the downsizing of the apparatus and the processing of the various types of sheets can be realized. Furthermore, since the printing unit 3 and the drying unit 6 which have large volumes are built up in a direction of gravitational force such that the sheet is conveyed within the apparatus in a semicircular direction in sequence of processing, so that the printing apparatus having small footprint can be realized.

The speed absorbing unit 7 according to a second exemplary embodiment of the present invention is described with reference to FIG. 11. Descriptions of the configurations other than the speed absorbing unit 7 are omitted here since those are similar to the ones in the first exemplary embodiment illustrated in FIG. 1.

According to a layout of the printing apparatus, a distance between an exit of the cutter unit 5 and an entrance of the drying unit 6 may become larger than a sheet length of a the maximum print unit. In this case, if the torque limiters are mounted on the driving shafts of all the feeding rollers of the speed absorbing unit 7, a cost of the apparatus becomes expensive. In the present exemplary embodiment, the distance that the sheet is conveyed through the speed absorbing unit is made larger while restraining the cost increase.

Figure 11A:
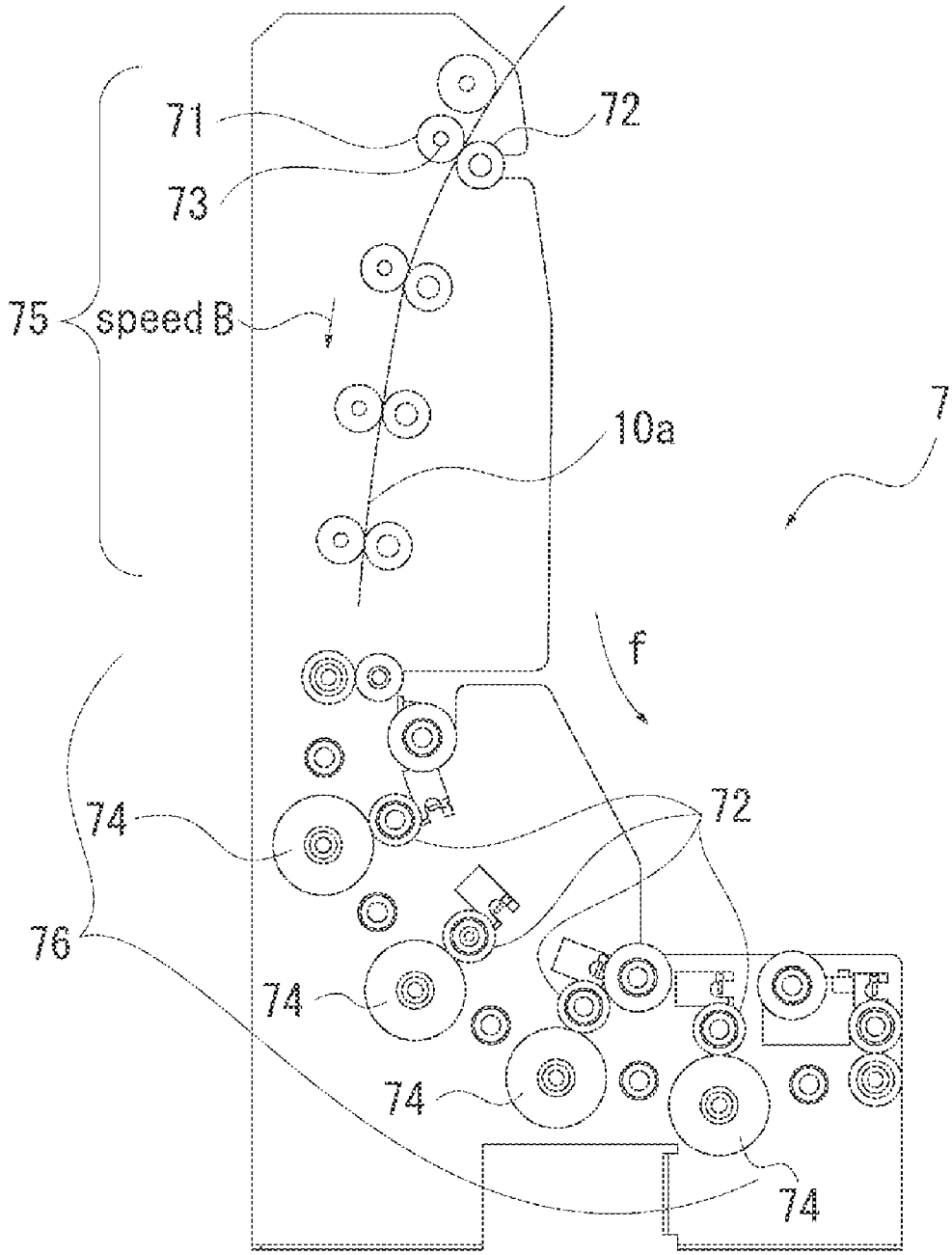
FIGS. 11A and 11B are cross sectional views of a speed absorbing unit according to a second exemplary embodiment.
Figure 11B:
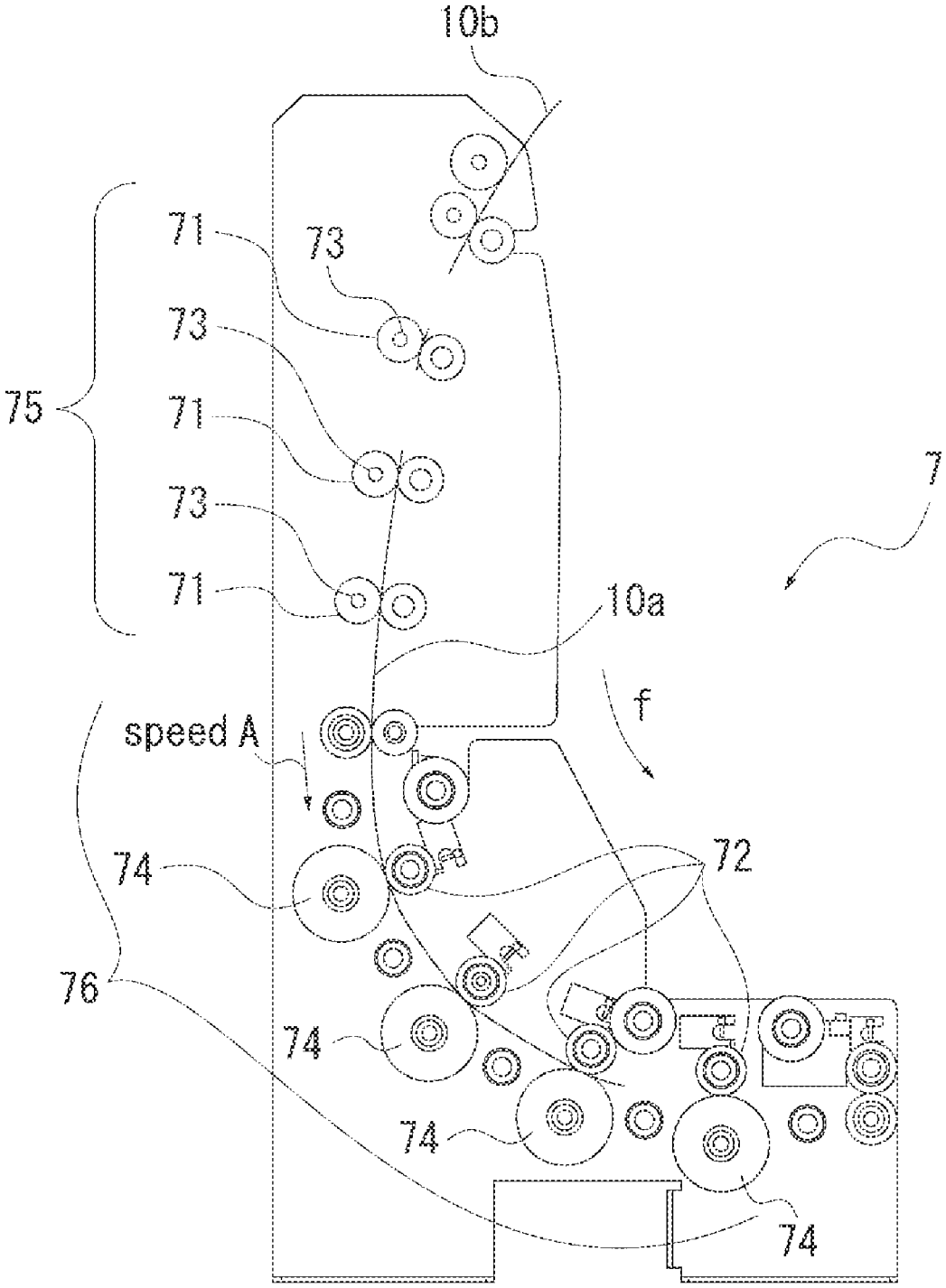

The speed absorbing unit 7 includes a first roller group 75 and a second roller group 76. In the first roller group 75, each of the plurality of rollers 71 is provided with a torque limiter mounted thereon. In the second roller group 76, none of a plurality of feeding rollers 74 is provided with a torque limiter. In the first roller group 75, each of the feeding rollers 71 rotates so as to convey the sheet at the conveyance speed B. A distance of the conveyance path of the first roller group 75 is larger than the maximum print unit sheet length. On the other hand, in the second roller group 76, each of the feeding rollers 74 rotates so as to convey the sheet at the conveyance speed A. As it is illustrated in FIG. 11A, the sheet 10*a* discharged from the cutter unit 5 at the conveyance speed B passes through the first roller group 75 at the conveyance speed B. Then, as illustrated in FIG. 11B, the leading edge of the sheet 10*a* advances into the second roller group 76 and is sandwiched between the pairs of the feeding roller 74 and driven roller 72.

As such, a speed of a portion of the sheet sandwiched by the feeding roller 74 and the driven roller 72 pair decreases to the speed A. The force is transmitted to the downstream side of the sheet 10*a* as the braking force to cause the torque limiters of the first roller group to idle. Accordingly, the overall conveyance speed of the sheet decreases to the speed A. Subsequently, the sheet 10*a* is discharged from the speed absorbing unit 7 at the conveyance speed A and advances into the drying unit 6.

As described above, the speed absorbing unit 7 includes the first roller group in which each of the rollers is provided with the torque limiter mounted thereon, and the second roller group in which none of the rollers is provided with the torque limiter, wherein the conveyance distance of the first roller group is larger than the print unit length of a piece of sheet. The conveyance speed of the first roller group is set to be larger than the conveyance speed of the second roller group. As a result thereof, a longer conveyance path can be obtained without increasing the number of the torque limiters.

The present invention is applicable not only to the printing apparatus but also to a sheet processing apparatus in which various types of processing (e.g., recording, processing, applying, irradiating, reading and testing) are performed onto a continuous sheet. In the above described exemplary embodiments, the printing unit 3 for performing the print processing (predetermined processing) may be regarded as a first processing unit and the drying unit 6 for performing the drying processing (another predetermined processing) may be regarded as a second processing unit. Another processing may be employed instead of the printing processing and the drying processing. The feeding rollers disposed between the cutter and the second processing unit absorbs the speed difference by the function of the torque limiter. Accordingly, the sheet processing apparatus of a small sized and having a high throughput can be realized.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-155675 filed Jun. 30, 2009, which is hereby incorporated by reference herein in its entirety.

What is claimed is:

1. An apparatus comprising:

a printing unit configured to print a plurality of images sequentially onto a sheet while conveying the sheet;

a cutter configured to cut the printed sheet into every print unit length;

a drying unit configured to dry the cut sheet while conveying the sheet piece by piece; and at least one feeding roller situated between the cutter and the drying unit configured to apply a driving force via a torque limiter, wherein a conveyance speed of the cut sheet is larger than the conveyance speed of the sheet conveyed through the drying unit, and the feeding roller absorbs a difference of the conveyance speed according to a function of the torque limiter.

2. The apparatus according to claim 1, wherein the sheet is a roll sheet, and the apparatus further comprising a roll sheet unit configured to hold the roll sheet to supply the sheet to the printing unit.

3. The apparatus according to claim 1, wherein the conveyance speed of the sheet conveyed through the printing unit is equal to the conveyance speed of the sheet conveyed through the drying unit.

4. The apparatus according to claim 1, wherein the conveyance speed of the sheet conveyed through the drying unit is equal to or larger than the conveyance speed of the sheet conveyed through the printing unit and a speed ratio is within a range approximately between 1.0 and 1.1 times.

5. The apparatus according to claim 1, wherein an idling torque of the torque limiter is smaller than a load that the sheet is buckled when a downstream side of the sheet is jammed and is larger than a conveyance load.

6. The apparatus according to claim 1, wherein a following relational formula is satisfied, provided that a length of a conveyance path from a cutting position of the cutter to the drying unit is L, a length of the cut sheet in a conveyance direction is M, the conveyance speed through the drying unit is A, a sheet discharge speed from the cutter after the sheet is cut is B, and a sheet conveyance stop time while the sheet is cut is T:

$$L/B<(B*T)/(B-A) \text{ and } M<L.$$

7. The apparatus according to claim 1, wherein a length of a conveyance path from a cutting position of the cutter to the drying unit is longer than a maximum print unit length of the sheet that is used in a conveyance direction.

8. The apparatus according to claim 7, further comprising a speed absorbing unit configured to include a plurality of feeding rollers, each of the feeding rollers being provided with the torque limiter, wherein a length of the conveyance path within the speed absorbing unit is longer than a maximum print unit length of the sheet used in the conveyance direction.

9. The printing apparatus according to claim 1, further comprising a speed absorbing unit having a first roller group which includes a first plurality of feeding rollers, each of the first feeding rollers being provided with the torque limiter mounted thereon, and a second roller group which includes a second plurality of feeding rollers, none of the second feeding rollers being provided with the torque limiter, wherein a conveyance speed attained from the first roller group is larger than the conveyance speed attained from the second roller group.

10. The apparatus according to claim 1, wherein, when the plurality of images are printed, a margin area is provided between one image and a following image, the cutter cuts the sheet twice at a leading edge and a trailing edge of the margin area, and the sheet conveyance stops at a cutting position when the cutter cuts the sheet.

11. The apparatus according to claim 1, wherein the printing unit, the cutter, the feeding roller and the drying unit are arranged along a sheet conveyance path in this order within a housing, and the drying unit is arranged downward of the printing unit in a direction of a gravitational force.

12. The apparatus according to claim 1, wherein the printing unit performs inkjet type printing.

13. An apparatus comprising:

a first processing unit configured to perform predetermined processing on a continuous sheet while conveying the sheet;

a cutter configured to cut the sheet into every unit length after the sheet is subjected to the predetermined processing of the first processing unit;

a second processing unit configured to perform second processing which is different from the predetermined processing while conveying the sheet cut by the cutter piece by piece; and at least one feeding roller situated between the cutter and the second processing unit configured to apply a driving force via a corresponding torque limiter, wherein a conveyance speed of the cut sheet is larger than the conveyance speed of the sheet conveyed through the second processing unit, and the feeding roller absorbs a difference of the conveyance speed according to a function of the torque limiter.

14. The apparatus according to claim 13, wherein the sheet is a roll sheet.

15. The apparatus according to claim 13, wherein an idling torque of the torque limiter is smaller than a load that the sheet is buckled when a downstream side of the sheet is jammed and is larger than a conveyance load.

16. The apparatus according to claim 13, further comprising a speed absorbing unit having a first roller group which includes a first plurality of feeding rollers, each of the first feeding rollers being provided with the torque limiter mounted thereon, and a second roller group which includes a second plurality of feeding rollers.

17. The sheet processing apparatus according to claim 16, wherein a conveyance speed attained from the first roller group is larger than the conveyance speed attained from the second roller group.

* * * * *